US011730644B2

(12) United States Patent
Gallois et al.

(10) Patent No.: US 11,730,644 B2
(45) Date of Patent: Aug. 22, 2023

(54) WHEELCHAIR

(71) Applicants: Colin Gallois, Lille (FR); Lancelot Durand, Lille (FR)

(72) Inventors: Colin Gallois, Lille (FR); Lancelot Durand, Lille (FR)

(73) Assignee: EPPUR, Loos (FR)

( * ) Notice: Subject to any disclaimer, the term of this patent is extended or adjusted under 35 U.S.C. 154(b) by 0 days.

(21) Appl. No.: 17/045,449

(22) PCT Filed: Apr. 3, 2019

(86) PCT No.: PCT/FR2019/050766
§ 371 (c)(1),
(2) Date: Oct. 5, 2020

(87) PCT Pub. No.: WO2019/193277
PCT Pub. Date: Oct. 10, 2019

(65) Prior Publication Data

US 2021/0169715 A1 Jun. 10, 2021

(30) Foreign Application Priority Data

Apr. 3, 2018 (FR) ..... 1852876

(51) Int. Cl.
*A61G 5/02* (2006.01)
*A61G 5/10* (2006.01)

(52) U.S. Cl.
CPC ..... *A61G 5/028* (2013.01); *A61G 5/1027* (2013.01)

(58) Field of Classification Search
CPC .... A61G 5/028; A61G 5/1027; A61G 5/1008; A61G 5/1035; A61G 5/02; A61G 5/1083
USPC ..... 280/250.1
See application file for complete search history.

(56) References Cited

U.S. PATENT DOCUMENTS 770,460 A * 9/1904 Glover ..... B62L 5/04 192/217.3
1,263,873 A * 4/1918 Emerson ..... B62L 5/04 192/217.3
1,280,428 A * 10/1918 Emerson ..... B62L 5/04 192/217.3
1,408,842 A * 3/1922 Svenson ..... B62L 5/04 192/217.6
2,012,893 A * 8/1935 Schmidt ..... B62L 5/04 192/217.6
2,252,774 A * 8/1941 Lesage ..... B62L 5/04 188/26

(Continued)

FOREIGN PATENT DOCUMENTS

CH 690985 A5 * 3/2001 ..... A61G 5/1008
CN 105326613 A * 2/2016

(Continued)

OTHER PUBLICATIONS

International Search Report for International Application No. PCT/FR2019/050766 dated Jul. 22, 2019, 3 pages.

(Continued)

*Primary Examiner* — Kevin Hurley
*Assistant Examiner* — Harold Eric Pahlck, III
(74) *Attorney, Agent, or Firm* — Workman Nydegger

(57) ABSTRACT

A wheelchair comprises a frame and two main wheels each coupled to a hand rim for actuating the wheels in both directions of rotation and for braking.

11 Claims, 5 Drawing Sheets

(56) References Cited

U.S. PATENT DOCUMENTS 2,572,182 A * 10/1951 Mueller ..... B62L 5/08 12/146 D
3,152,674 A * 10/1964 Witte ..... B62L 5/04 192/217.6
3,252,552 A * 5/1966 Gleasman ..... B62L 5/08 188/26
3,892,301 A * 7/1975 Frei ..... B62L 5/08 188/26
4,093,261 A * 6/1978 Persson ..... B62L 5/04 280/238
4,371,064 A * 2/1983 Shimano ..... B62M 9/12 192/217.5
4,679,862 A * 7/1987 Luo ..... A61G 5/10 301/124.2
4,727,965 A * 3/1988 Zach ..... A61G 5/02 192/217.4
4,733,755 A * 3/1988 Manning ..... A61G 5/10 188/31
4,758,013 A * 7/1988 Agrillo ..... B62M 1/14 280/250
5,027,930 A * 7/1991 Reed ..... B62L 5/08 188/24.17
5,064,035 A * 11/1991 Tsuchie ..... B62L 5/02 192/217.6
5,161,630 A * 11/1992 Garin, III ..... A61G 5/0825 180/907
5,211,414 A * 5/1993 Galumbeck ..... A61G 5/128 188/30
5,401,044 A * 3/1995 Galumbeck ..... A61G 5/128 188/2 F
5,482,305 A * 1/1996 Jeffries ..... A61G 5/1054 475/331
5,657,836 A * 8/1997 BeVier ..... A61G 5/025 188/24.17
5,791,672 A * 8/1998 Masclet ..... A61G 5/0825 301/124.2
5,938,560 A * 8/1999 Steuer ..... B62M 11/16 192/217.4
6,276,760 B1 * 8/2001 Everett ..... B62B 7/06 280/47.38
6,386,566 B1 * 5/2002 Freeberg ..... F16D 41/24 280/259
6,428,028 B1 * 8/2002 Folino ..... A61G 5/028 475/168
6,467,785 B2 * 10/2002 Toppses ..... A61G 5/1059 280/250.1
6,644,443 B1 * 11/2003 Jager ..... A61G 5/101 188/69
6,755,430 B1 * 6/2004 Watwood ..... A61G 5/1027 280/250.1
8,002,300 B2 * 8/2011 Ludovici ..... A61G 5/1054 280/649
8,915,513 B2 * 12/2014 Garcia Franca ..... A61G 5/022 280/250.1
8,931,796 B2 * 1/2015 Nasser ..... F16H 3/66 280/250.1
9,010,786 B1 * 4/2015 Ekelem ..... A61G 5/1035 280/244
9,408,762 B1 * 8/2016 Baker ..... A61G 5/025
9,610,805 B2 * 4/2017 van den Berg ..... F16D 41/24
9,644,730 B2 * 5/2017 Judge ..... A61G 5/1083
9,687,397 B1 * 6/2017 Lin ..... B60B 37/10
9,795,522 B2 * 10/2017 Hansen ..... A61G 5/0875
9,795,523 B2 * 10/2017 Holst ..... B60B 27/0026
9,867,746 B2 * 1/2018 Chiang ..... A61G 5/026
10,011,320 B2 * 7/2018 Chang ..... B60B 27/0047
2006/0197302 A1 * 9/2006 Meginniss, III ..... A61G 5/02 280/250.1
2008/0073869 A1 * 3/2008 Patterson ..... A61G 5/023 280/244
2009/0039612 A1 * 2/2009 Bidwell ..... A61G 5/02 280/250.1
2014/0013891 A1 * 1/2014 Malm ..... A61G 5/023 74/473.13
2016/0015580 A1 * 1/2016 Zondervan ..... A61G 5/024 280/244

FOREIGN PATENT DOCUMENTS

CN 107028707 A * 8/2017 ..... A61G 5/00
DE 749117 C * 11/1944
DE 765719 C * 6/1953
DE 4316254 A1 * 11/1994 ..... A61G 5/10
DE 102013109865 A1 * 3/2015 ..... A61G 5/045
DE 202016103032 U1 * 6/2016 ..... A61G 5/042
DE 202016103032 U1 * 8/2016
EP 1627619 5/2006
FR 434729 A * 2/1912
FR 0685706 A 2/1930
FR 685706 A * 7/1930
FR 2548096 A1 * 1/1985
FR 2671312 A1 * 7/1992 ..... A61G 5/1008
FR 2860430 A1 * 4/2005 ..... A61G 5/1008
GB 460131 A * 1/1937
JP 1994-165799 A 6/1994
JP 3689101 B1 * 8/2005
KR 20180028848 A * 3/2018
WO WO-2007145581 A1 * 12/2007 ..... A61G 5/023

OTHER PUBLICATIONS

International Written Opinion for International Application No. PCT/FR2019/050766 dated Jul. 22, 2019, 7 pages.

* cited by examiner

WHEELCHAIR

CROSS-REFERENCE TO RELATED APPLICATIONS

This application is a national phase entry under 35 U.S.C. § 371 of International Patent Application PCT/FR2019/050766, filed Apr. 3, 2019, designating the United States of America and published as International Patent Publication WO 2019/193277 A1 on Oct. 10, 2019, which claims the benefit under Article 8 of the Patent Cooperation Treaty to French Patent Application Serial No. 1852876, filed Apr. 3, 2018.

TECHNICAL FIELD

The present disclosure concerns the field of non-motorized wheelchairs for the elderly or disabled.

These wheelchairs must be light, very robust and enable easy manual movement.

For this purpose, wheelchairs usually have two side drive wheels driven by a hand-rim enabling the user to turn the wheel, possibly at different speeds in order to steer the wheelchair, and also to brake the wheelchair.

BACKGROUND

The state of the art discloses French patent FR685706 concerning a freewheel and backpedaling brake hub for tricycles, invalid carriages, etc., adapted to enable the wheel to be driven in the reverse direction, by the use of a ratchet mechanism interposed between the cycle, etc., a fork and a member carrying the brake band, etc., and adapted to prevent the rotation of such member in the forward direction, but to allow its rotation in the backward direction, with sufficient friction to permit the operation of the brake. The driving chain plate is mounted on a sleeve having a screw thread engaging in a member, which drives the hub in the forward direction (Arrow F) through a pawl-and-ratchet mechanism permitting a freewheel action. On back-pedaling (Arrow B), the member is traversed by the screw thread so as to engage its conical clutch part in a cup, which then rocks a lever about its pivot on a plate, to expand a band into contact with a brake drum.

This document mainly concerns a cycle wheel of the back-pedaling type with one (single) wheel for a cycle with a fork for one single rear wheel.

A "carriage for the maimed" disclosed, in 1929 (the date on which this patent was filed), a tricycle with only one drive wheel at the back, driven in the manner of a bicycle wheel.

This document never refers to the operation of the wheel by a hand-rim (and it is difficult to see where it would be fixed on a "carriage for the maimed"), nor to the use of two wheels (if they were not paired but arranged on either side of a device, the latter could not move forward), let alone the use of two wheels with different structures.

A "carriage for the maimed" cannot be likened to a wheelchair.

Furthermore, Japanese patent JPH06 165799 discloses a wheelchair that comes to a stop positively at a position where it is oriented in an advancing direction without braking it halfway through a slope by allowing the wheelchair to have a simply designed and lightly switchable back stop function. A switching handle is turned counterclockwise when a wheelchair is rolled outdoors or is about to climb up an ascending slope. Then when the wheelchair is located halfway through a slope, and its user keeps his hand off the hand-rim, a one-way clutch with a bearing becomes firmly engaged, while a wheel hub tends to rotate clockwise, and thus no wheel rotation occurs. That is, the wheel hub can rotate counterclockwise but cannot rotate clockwise, preventing the wheelchair from rolling backward. If the switching handle is rotated clockwise, a cylindrical claw climbs up along the claw of a cylindrical bolt to permit an engagement between the crests of the claws. Furthermore, a pin slides out of a hole in the wheel hub, so that the wheel hub is completely separated from a hub shaft and the wheel hub can rotate freely again.

This patent describes a solution requiring an operating lever and does not enable braking, forward travel and reverse travel by a single action on the same element, namely the hand-rim of each of the drive wheels.

U.S. Pat. No. 5,027,930 describes a coaster brake assembly brake, which is coupled directly to a drive shaft. The drive shaft has a threaded driver integral thereon. A clutch cone having internal threads traverses in axial directions as it threads on or off the driver depending on the rotation of the driver. A brake cone is provided, which has a smooth axial bore through which the drive shaft rotates. The axial movement of the clutch cone toward the brake cone operates to force brake shoes against the inside wall of the hub. A spring is provided to facilitate the threading action between the clutch cone and the driver.

This patent describes a bicycle comprising only one drive wheel, with no hand-rim to drive it.

BRIEF SUMMARY

The solutions of the prior art closest to the present disclosure concern non-motorized wheelchairs driven by hand-rims on which the user exerts repeated pushes. To brake, the user blocks the hand-rim with the palm of his hand. When the braking torque is high, it is usual for the user to apply pressure intermittently so as not to burn the palm of the hand.

In order to overcome these drawbacks, the present disclosure concerns, in the broadest sense, a wheelchair comprising a frame and two main drive wheels (the drive being human) each coupled to a hand-rim for actuating the wheels in both directions of rotation and for braking characterized in that the frame is equipped:

- on the right-hand side in relation to the normal direction of movement
  - with a connecting means with a side shaft locking in the clockwise direction and freely rotating in the counterclockwise direction
  - the right hand-rim being mounted freely rotating in relation to the side shaft, without freedom of axial translation
  - the right wheel being provided with a hub connected to the hand-rim by a connecting means locking in the clockwise direction
  - the hub comprising a means of braking the rotation of the hub in relation to the side shaft, actuated by the counterclockwise movement of the hand-rim in relation to the side shaft
- on the left-hand side in relation to the normal direction of movement
  - with a connecting means of a side shaft locking in the counterclockwise direction and freely rotating in the clockwise direction
  - the left hand-rim being mounted freely rotating in relation to the side shaft, without freedom of axial translation the left wheel being provided with a hub connected to the hand-rim by a connecting hub locking in the counterclockwise direction the hub comprising a means of braking the rotation of the hub in relation to the side shaft, actuated by the counterclockwise movement of the hand-rim in relation to the side shaft.

The "clockwise" or "counterclockwise" direction is understood to relate to when the wheel is observed from outside the wheelchair.

The braking means are assured by two complementary surfaces in relative motion, for example, the tapered surface of an axially mobile unit with a complementary tapered surface inside the hub.

According to a variation, the means of connecting the side shafts to the frame are formed by roller freewheels.

According to another variation, the means of connecting the side shafts to the frame are formed by ratchet freewheels.

According to another possible variation, the connection area of the frame is located between the connecting means of a side shaft on the one hand, and the wheel and hand-rim on the other.

According to a particular embodiment, the means of connecting the side shaft to the frame comprise a rapid-connection means of the side shaft.

The present disclosure also concerns a kit comprising a pair of wheels for a wheelchair formed by an assembly intended for the right-hand side of the wheelchair in relation to the normal direction of movement, formed by a right hand-rim mounted freely rotating in relation to a side shaft, with no freedom of axial translation the right wheel being provided with a hub connected to the hand-rim by a connecting means locking in the clockwise direction the hub comprising a means of braking the rotation of the hub in relation to the side shaft, actuated by the counterclockwise movement of the hand-rim in relation to the side shaft.

The two wheels of the kit are of different types as regards the direction of locking of the hub.

BRIEF DESCRIPTION OF THE DRAWINGS

A better understanding of the present disclosure will emerge from the following detailed description of a non-limiting example of an embodiment of the present disclosure made with reference to the accompanying drawings, in which.

DETAILED DESCRIPTION

Figure 1:
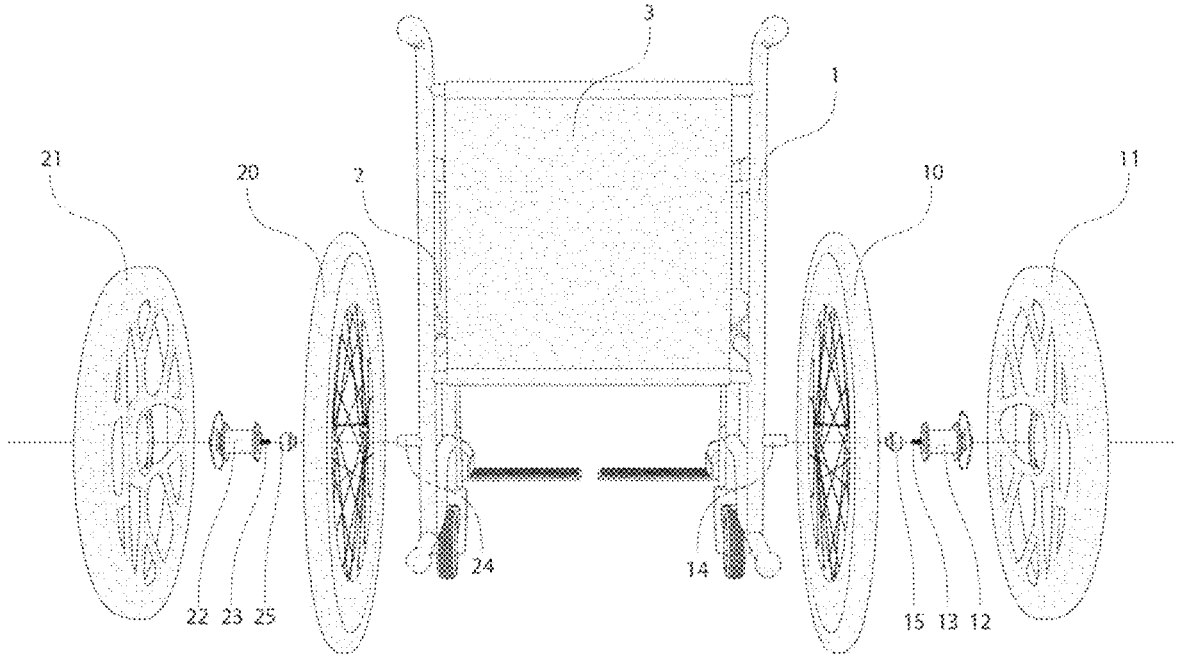
FIG. 1 represents an exploded view of a wheelchair according to the present disclosure.

The wheelchair is formed in general manner of a frame (1) supporting a seat (2) and a back (3).

The wheelchair comprises a right wheel (10) and a left wheel (20), in relation to the normal direction of movement of the wheelchair.

Each wheel (10, 20) can be actuated by a hand-rim (11, 21), respectively. The coupling between the left wheel (20) and the associated left hand-rim (21) is ensured by a left hub (22), the operation of which will be described below. The same applies to the coupling of the right wheel (10) to the right hand-rim (11), ensured by a right hub (12).

A shaft (23) passes through the hub (22) of the wheel (20) associated with the hand-rim (21), as well as the flange (25) integral with the structure (24). The inner end of the shaft (23) is held by a flange (25) containing a roller freewheel integral with the flange (25).

Figure 2:
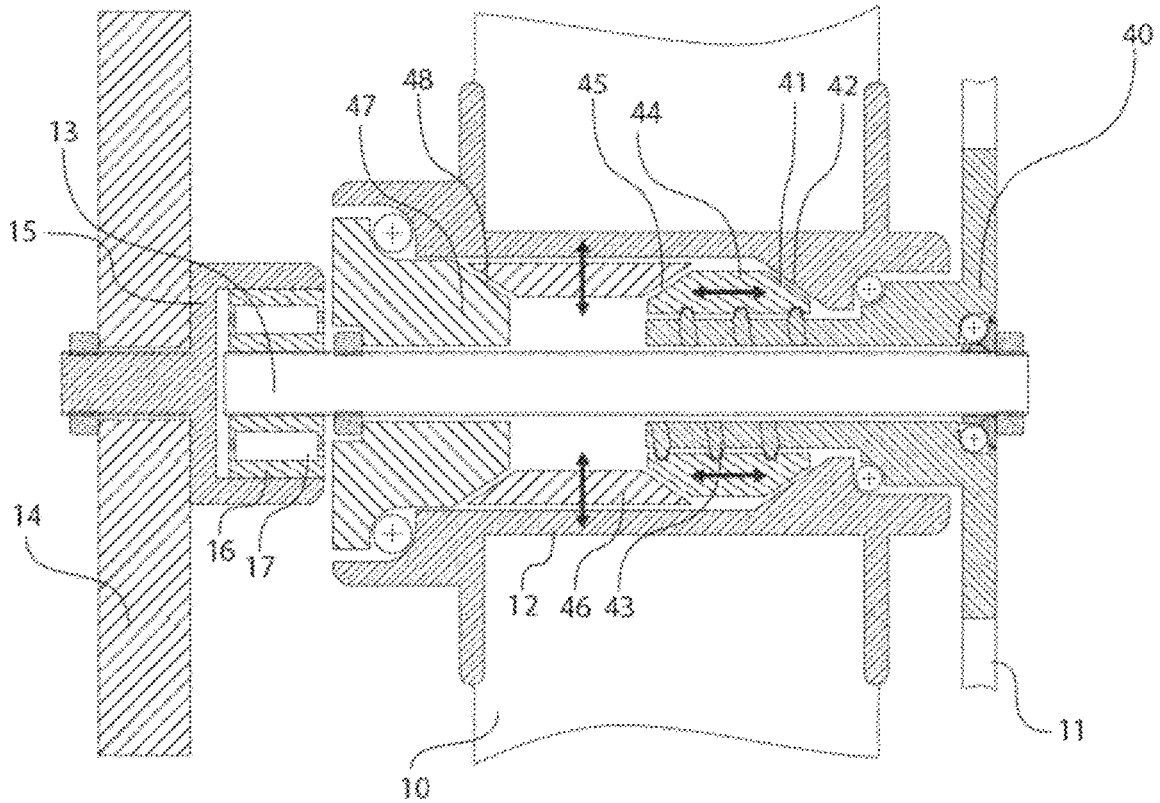
FIG. 2 represents a cross-sectional view of the wheel according to a first embodiment where the flange containing a roller freewheel is positioned between the main shaft and the frame.

FIG. 2 represents a detailed view of the wheel according to a first variation where the flange containing a roller freewheel is positioned between the wheel and the frame of the wheelchair.

The flange (15) containing a roller (17) freewheel (16) is fixed to the frame (14) by means of a rod axially extending the surface opposite the hub. This rod is screwed to the frame of the wheelchair. It can also be fixed by a rapid-connection system. Such a rapid-connection system is formed, for example, by a rod extending the outer face of the flange and passing through the frame of the wheelchair. The rod can be retained by a lock actuated by a spring or any other known means.

This flange (15) contains a roller (17) freewheel (16) enabling the rotation of the shaft (13).

For the left wheel, the flange (25) contains a roller freewheel enabling the rotation of the shaft (23), integral with the wheel, in the clockwise direction (counter-trigonometric direction), but locking the rotation in the counter-clockwise direction for the right wheel.

For this purpose, the freewheel (16) has, in a known way, inclined ramps. The rollers (17) engage between the inclined ramps and the cylindrical internal surface of the flange (15), assisted by a return spring acting on a roller cage. The friction between the rollers (17) and the inclined-ramp freewheel (16) on the one hand and between the rollers (17) and the flange (15) on the other, as well as the geometry of the parts, creates an over-center producing braking by adhesion. When the shaft (13) turns in the counterclockwise direction in relation to the flange, the rollers disengage and enable a free rotation in relation to the flange (15), for the right wheel, and in the clockwise direction for the left wheel.

The hand-rim (11) drives the wheel (40) provided with a screw thread (43).

The inner end of the wheel (40) has a screw thread (43) driving a mobile unit (44) having a ramp (45).

When the mobile unit (44) is moved axially outwards, its convex tapered outer end (41) comes into contact with the concave bearing surface (42) of the hub (12) integral with the right wheel (10) and thus ensures a coupling between the hand-rim (11) and the right wheel (10).

When the mobile unit (44) is moved axially inwards, it ensures the compression of a braking ring (46), the opposite end of which rests on a cone (47) and the outer face of which radially exerts a gradual friction on the hub (12) of the right wheel (10).

The characteristics of the hub, particularly the translational travel of the mobile unit, and the pitch of the screw thread are determined so that the movement from one end to the other is achieved by a relative angular travel between the hand-rim and the associated wheel of approximately 1°, and preferably between 0.1° and 10°, and more preferably between 0.1° and 2°.

According to a variation, a return screw pushes the hand-rim, in the absence of force being applied thereto by the user, into its forward travel position. This spring is, for example, arranged in the hub so as to push the mobile unit outwards, in the opposite direction to the frame. Thus the mobile unit (44) is pushed to rest in a position where the convex tapered outer end (41) comes into contact with the concave bearing surface (42) of the hub (12), under the action of a spring, for example.

Figure 3:
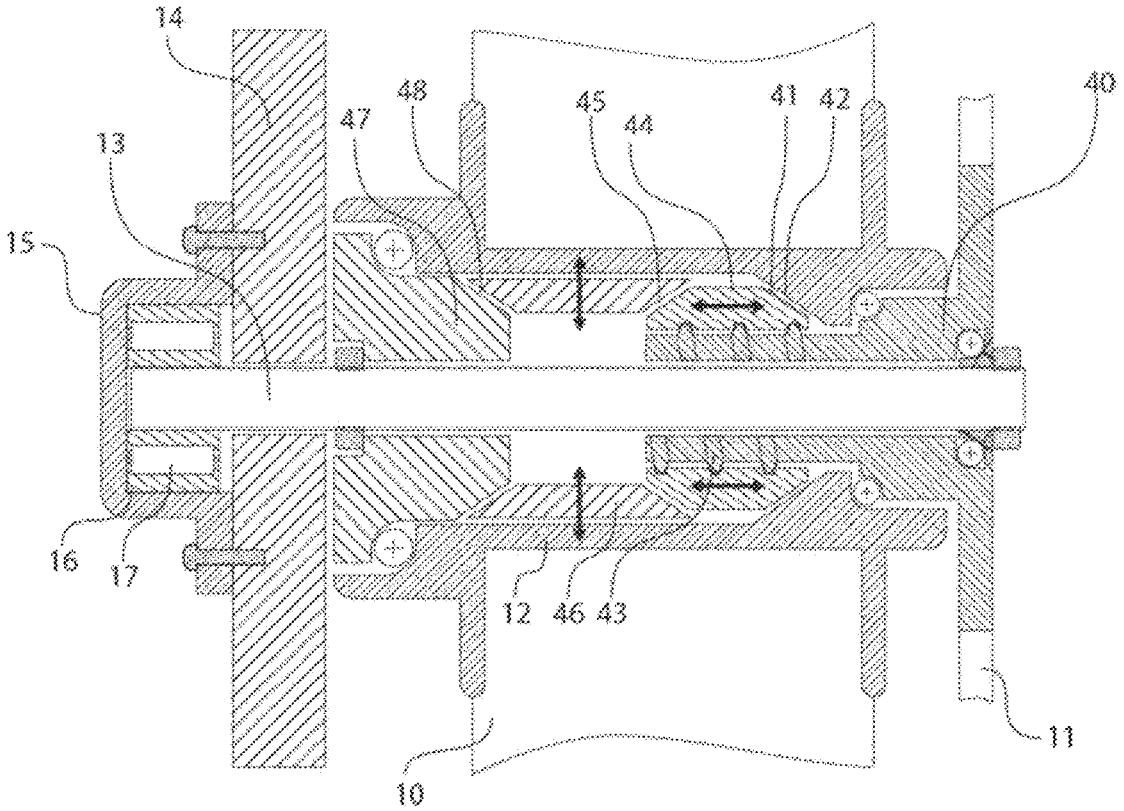
FIG. 3 represents a cross-sectional view of the wheel according to a second embodiment where the flange containing a roller freewheel is positioned inside the wheelchair.

FIG. 3 represents a detailed view of the wheel according to a second variation where the flange containing a roller freewheel is positioned inside the wheelchair.

The wheel comprises a flange (15) coaxial with the hub (12).

The flange (15) is fixed to the inner surface of the frame (14) of the wheelchair, by welding or by bolts or rivets.

This flange (15) contains a roller (17) freewheel (16) enabling the rotation of the shaft (13), integral with the freewheel (16), in the counterclockwise direction (trigonometric direction), but locking the rotation in the clockwise direction for the right wheel.

For the left wheel, the flange (25) contains a roller freewheel enabling the rotation of the shaft (23), integral with the wheel, in the clockwise direction (trigonometric direction), but locking the rotation in the counterclockwise direction for the right wheel.

For this purpose, the freewheel (16) has, in a known way, inclined ramps. The rollers (17) engage between the inclined ramps and the cylindrical inner surface of the flange (15), aided by a return spring acting on a roller cage. The friction between the rollers (17) and the inclined-ramp freewheel (16) on the one hand, between the rollers (17) and the flange (15) on the other, as well as the geometry of the parts, creates an over-center producing braking by adhesion. When the shaft (13) turns in the counterclockwise direction in relation to the flange, the rollers disengage and enable a free rotation in relation to the flange (15), for the right wheel, and in the clockwise direction for the left wheel.

The hand-rim (11) drives the wheel (40) provided with a screw thread (43).

The inner end of the wheel (40) has a screw thread (43) driving a mobile unit (44) having a ramp (45).

When the mobile unit (44) is moved outwards, its convex tapered outer end (41) comes into contact with the concave bearing surface (42) of the hub (12) integral with the right wheel (10) and thus ensures a coupling between the hand-rim (11) and the right wheel (10).

When the mobile unit (44) is moved axially inwards, it ensures the compression of a braking ring (46), the opposite end of which rests on a cone (47) and of which the outer face radially exerts a gradual friction on the hub (12) of the right wheel (10).

Figure 4:
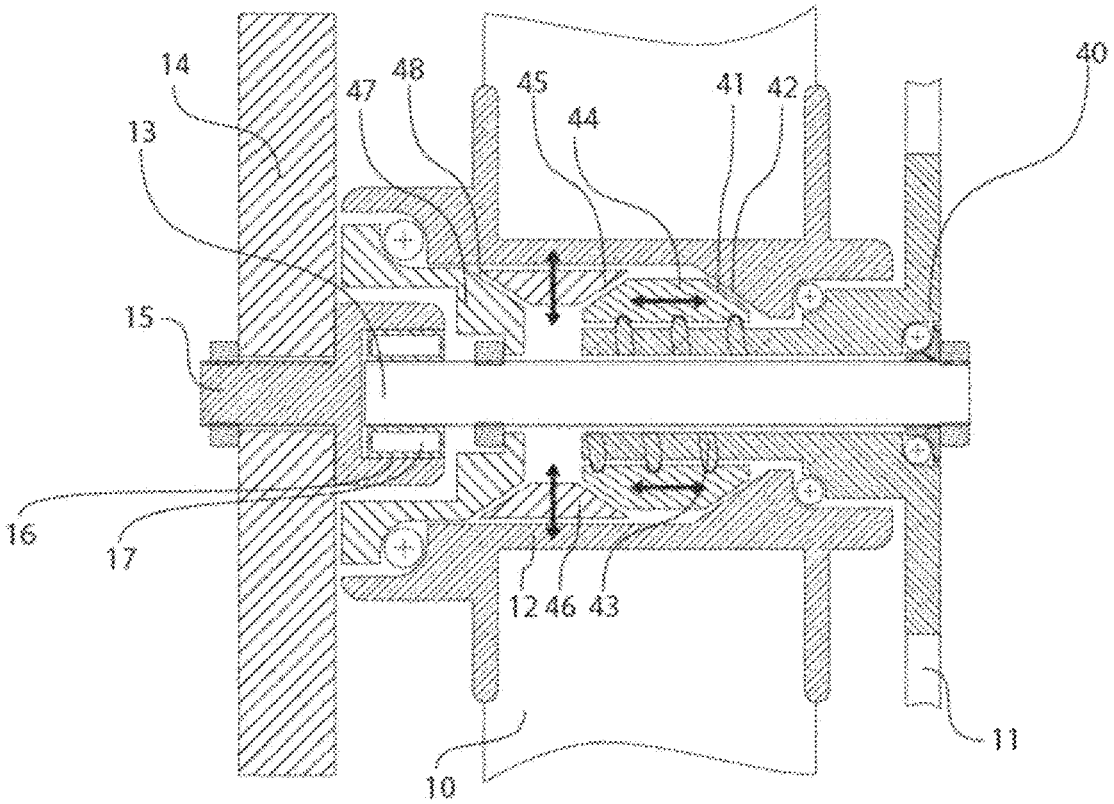
FIG. 4 represents a cross-sectional view of the wheel according to a third embodiment corresponding to a more compact embodiment than the first variation.

FIG. 4 represents a third variation. The wheel is distinguished from the first variation by the fact that the flange (15) is fixed to the outer ring of the roller (17) freewheel (16). The inner ring of the ball freewheel is fixed to the side shaft (13).

Figure 5:
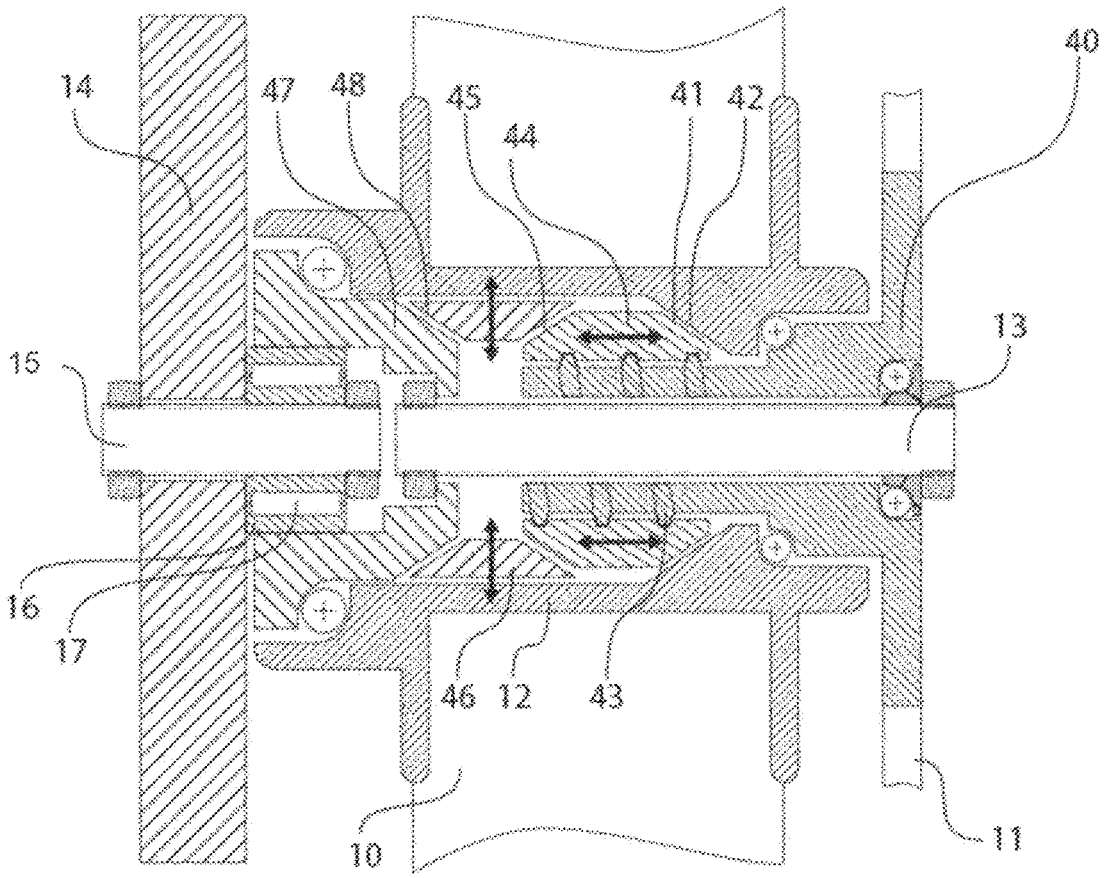
FIG. 5 represents a cross-sectional view of the wheel according to a fourth embodiment where the flange containing a roller freewheel is housed in the hub of the wheel.

FIG. 5 shows another variation of the system, with the advantage of being more compact. Compactness enabling the user, among other things, to pass through doorways.

The kinematics of the system are identical to the variations described above. The difference with this variant lies in the fact that the means (15) connecting the side shafts to the frame are located in an internal recess of the cap (47) securing the hub.

The connection of the side shaft (13) to the frame is still achieved via a connection means locking in the clockwise direction and rotating freely in the counterclockwise direction. The outer ring of the roller (17) freewheel (16) is fixed to an internal face of the cap (47) itself integral with the side shaft (13). The inner ring of the ball freewheel is fixed to the frame, via a second side shaft (13).

The present disclosure also relates to a pair or wheels associated with the above-mentioned mechanisms, to enable the transformation of an existing wheelchair.

Figure 6:
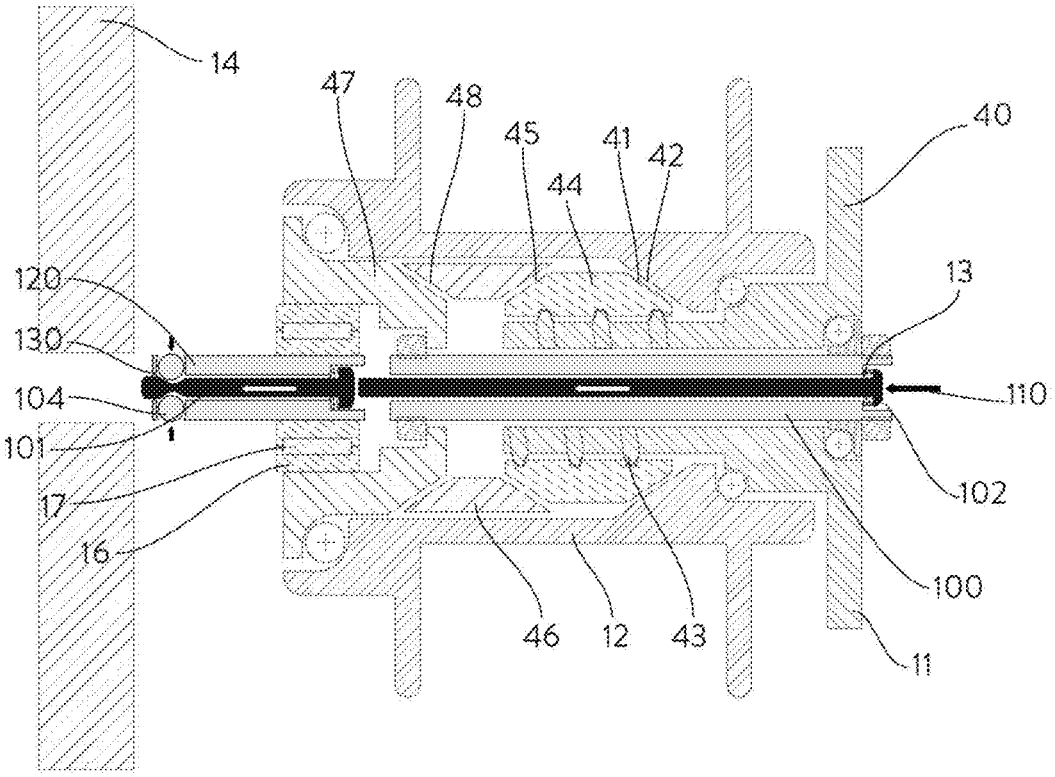
FIGS. 6 and 7 represent a cross-sectional view of the wheel according to the fourth embodiment, with a rapid-connection system, in the disengaged position and the engaged position, respectively.
Figure 7:
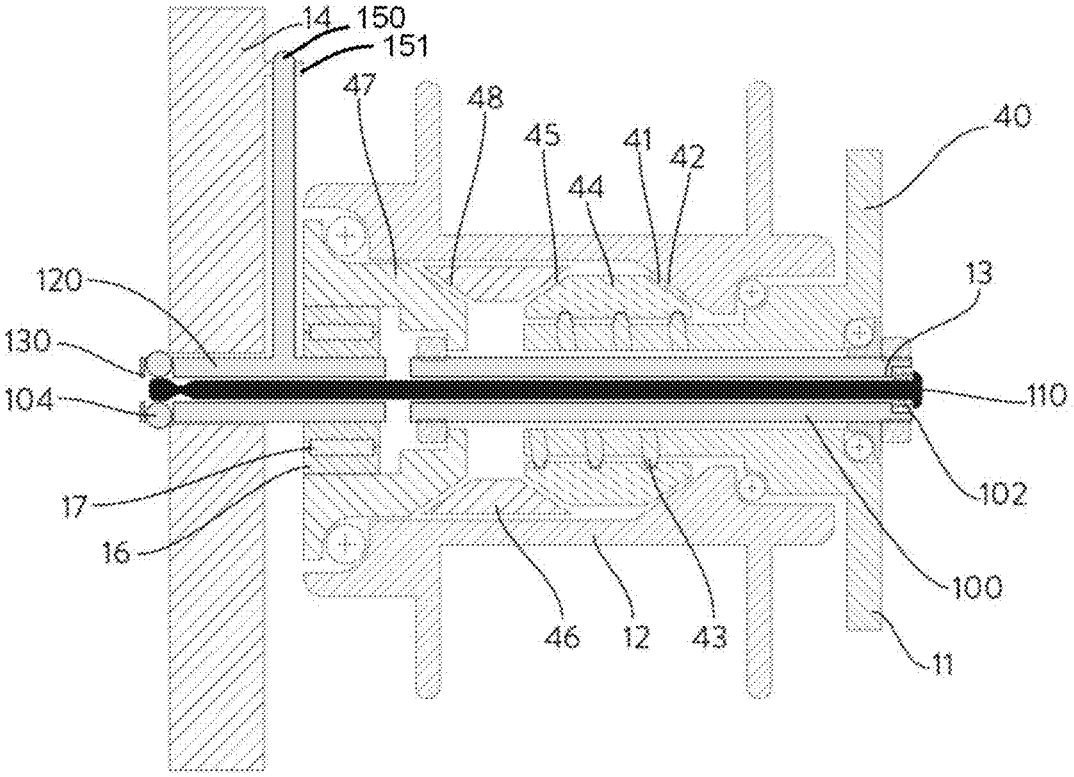

A particular variation shown in FIGS. 6 and 7 concerns the fixing of wheels onto the frame of a wheelchair by means of a rapid-connection system when the wheel is separated from the wheelchair and when the wheel is fixed to the wheelchair, respectively.

Such a system is formed by a rod made up of two coaxial and contiguous portions (100 and 120), the forward front end of the portion (100) coming into contact with the rear front end of the portion (120), both portions (100, 120) being free in relative rotation.

In the example described, the rod formed by the two portions (100, 120) has a coaxial pin (110) passing through it. Alternatively, this rod can be made as a single portion passing through the entire wheel hub.

The first portion (100) passes through the hub and the hollow shaft (13).

The second portion (120) passes through the shaft of the roller freewheel (16).

The wall of the front end of the portion (120) has apertures for the passage of balls (104) radially mobile between one position where they form a protuberance in relation to the outer surface of the portion (120), thus increasing the cross-section, and one centripetal position where they are flush. Depending on the position of the balls, the section of the front part of the portion (120) enables engagement in a housing of the wheelchair frame with a complementary section to the section of the portion (120), when the balls are in a centripetal position, and when the balls are driven outwards, ensures the locking of the portion (120) in the wheelchair frame.

A pin (110) passes through both portions (100, 120) and at its front end has an annular groove extended forwards by a truncated-cone-shaped end part enabling the balls to be pushed back when the pin (110) engages in the inner channel of both portions (100, 120). The annular groove has a radius of curvature complementary to the radius of the balls (104). When this groove is pushed back to the balls, they can move into a centripetal position. At rest, a spring (102) pushes the pin (110) backwards and the annular groove moves so that the balls are driven into a centrifugal position by the tubular section of the pin (110).

The rapid-connection system is provided with an anti-rotation means, formed by a tab (150) the end of which is designed to be fixed to a fixed part of the wheelchair frame. The end of this tab (150) has an aperture to engage a lug (151) extending the surface of the wheelchair frame.

Figure 8:
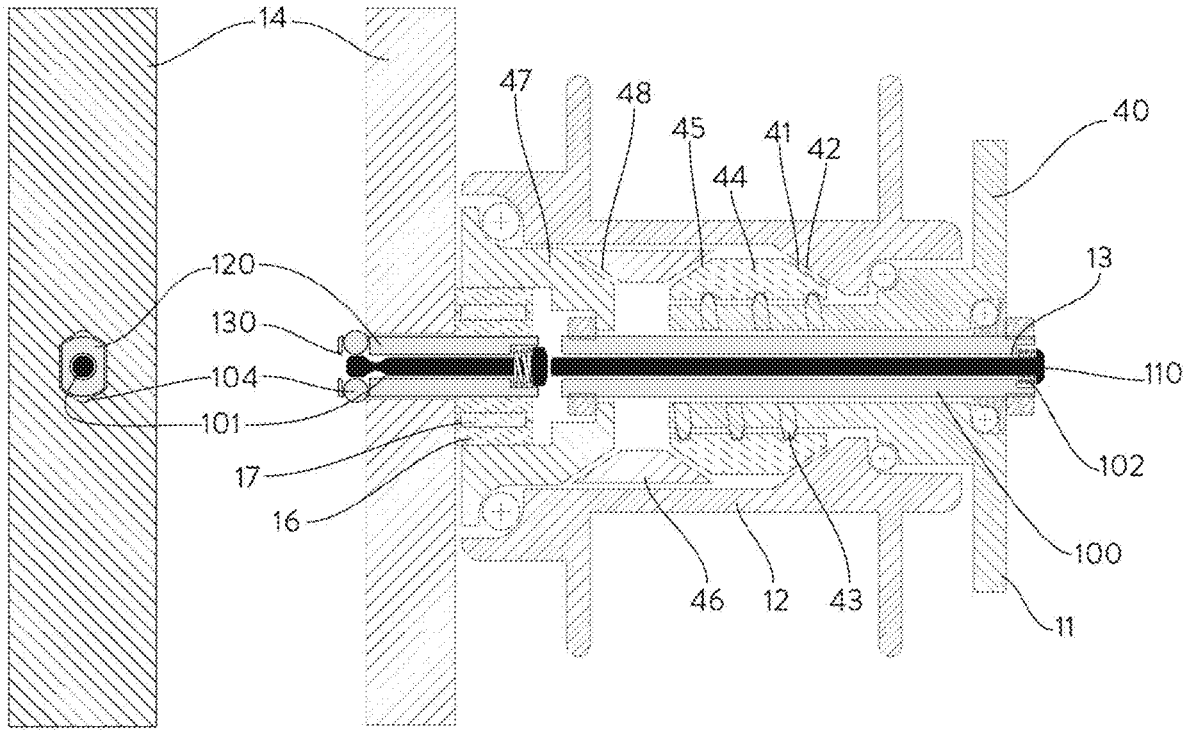
FIG. 8 represents a cross-sectional view and front view of the wheel with a variation of the rapid-connection system.

In the example shown in FIG. 8, this anti-rotation means is formed by a flat piece with a cross-section complementary to that of the front end of the portion (120).

The invention claimed is:

1. A pair of wheel assemblies for a wheelchair, comprising:

a right-hand side assembly including a right hand-rim mounted freely rotating in relation to a right side shaft with no freedom of axial translation, the right hand-rim having a screw thread that is integral with said right hand-rim, said screw thread being drivingly engaged with a right axially mobile unit having a ramp, a right wheel provided with a right hub and a right freewheel locking in the clockwise direction, the right hub comprising a right braking device for braking the rotation of the right hub with respect to the right side shaft, the right braking device being actuatable by a counterclockwise movement of the right hand-rim with respect to the right side shaft, the right hub comprising a right cap having a conical surface, the right braking device comprising a right braking element having a first conical end and a second conical end, wherein, during actuation of the right braking device by the counterclockwise movement of the right hand-rim, the right axially mobile unit is moved axially towards the braking element and the ramp of the right axially mobile unit is engaged with said first conical end of the right braking element and the second conical end of the right braking element is engaged with said conical surface of the right cap, wherein the right freewheel is in an internal recess of the right cap, said right freewheel having an outer ring fixed with respect to the right cap and an inner ring fixed with respect to the right side shaft; and a left-hand side assembly including a left hand-rim mounted freely rotating in relation to a left side shaft with no freedom of axial translation, the left hand-rim having a screw thread that is integral with said left hand-rim, said screw thread being drivingly engaged with a left axially mobile unit having a ramp, a left wheel provided with a left hub and a left freewheel locking in the counterclockwise direction, the left hub comprising a left braking device for braking the rotation of the left hub with respect to the left side shaft, the left braking device being actuatable by a clockwise movement of the left hand-rim with respect to the left side shaft, the left hub comprising a left cap having a conical surface, the left braking device comprising a left braking element having a first conical end and a second conical end, wherein, during actuation of the left braking device by the clockwise movement of the left hand-rim, the left axially mobile unit is moved axially towards the breaking element and the ramp of the left axially mobile unit is engaged with said first conical end of the left braking element and the second conical end of the left braking element is engaged with said conical surface of the left cap, wherein the left freewheel is in an internal recess of the left cap, said left freewheel having an outer ring fixed with respect to the left cap and an inner ring fixed with respect to the left side shaft.

2. The pair of wheel assemblies of claim 1, wherein the right-hand side assembly comprises a right rapid connection system formed by a right rod passing through the right side shaft and a right coaxial pin passing through the right rod, a wall of the right rod having apertures for a passage of balls radially mobile between a deployed position where they form a protuberance in relation to an outer surface of the right rod, thus increasing a cross-section of said right rod, and one centripetal position where they are flush, the balls cooperating with the right coaxial pin in such way that the balls are pushed to the deployed position when the right coaxial pin engages the right rod, and wherein the left-hand side assembly comprises a left rapid connection system formed by a left rod passing through the left side shaft and a left coaxial pin passing through the left rod, a wall of the left rod having apertures for a passage of balls radially mobile between a deployed position where they form a protuberance in relation to an outer surface of the left rod, thus increasing a cross-section of said left rod, and one centripetal position where they are flush, the balls cooperating with the left coaxial pin in such way that the balls are pushed to the deployed position when the left coaxial pin engages the left rod.

3. The pair of wheel assemblies of claim 2, wherein the rapid-connection system further comprises an anti-rotation mechanism formed by a tab, an end of the tab configured to be fixed to a wheelchair frame.

4. The pair of wheel assemblies of claim 1, wherein the right and left freewheels are roller freewheels.

5. The pair of wheel assemblies of claim 1, wherein the right axially mobile unit comprises a convex tapered outer end and wherein the right hub comprises a concave bearing surface, said convex tapered outer end coming into contact with said concave bearing surface when said right axially mobile unit is moved axially towards the concave bearing surface of the right hub, thereby locking in rotation the right hand-rim to the right wheel.

6. A wheelchair wheel assembly, comprising:

a hand-rim mounted freely rotating in relation to a side shaft with no freedom of axial translation, the hand-rim having a screw thread drivingly engaged with an axially mobile unit having a ramp, said screw thread being integral with said hand-rim;

a wheel provided with a hub and a freewheel, the hub comprising a braking device for braking the rotation of the hub in relation to the side shaft, the braking device comprising a braking element having a first conical end, the braking device being actuatable by a counterclockwise movement of the hand-rim with respect to the side shaft causing the axially mobile unit to move axially towards the braking element and the ramp of the axially mobile unit, thereby engaging with said first conical end of the braking element, wherein the axially mobile unit comprises a convex tapered outer end and wherein the hub comprises a concave bearing surface, said convex tapered outer end coming into contact with said concave bearing surface when said axially mobile unit is moved axially towards the concave bearing surface of the hub, thereby locking in rotation the hand-rim to the wheel.

7. A wheelchair, comprising:

a frame having a right lug and a left lug;

a right wheel rotatable with respect to the frame and coupled to a right hand-rim for actuating the right wheel in both directions of rotation and for braking, the right wheel having a right side shaft fixed to the frame, the right hand-rim being mounted freely rotating in relation to the right side shaft, without freedom of axial translation, the right wheel having a right hub and a right freewheel locking in the clockwise direction, the right hub comprising a braking device for braking the rotation of the right hub in the clockwise direction, said braking device having a right cap and being actuatable by a counterclockwise movement of the right hand-rim with respect to the right side shaft, said right cap having a conical surface;

a left wheel rotatable with respect to the frame and coupled to a left hand-rim for actuating the left wheel in both directions of rotation and for braking, the left wheel having a left side shaft fixed to the frame, the left hand-rim being mounted freely rotating in relation to the left side shaft, without freedom of axial translation, the left wheel having a left hub and a left freewheel locking in the counterclockwise direction, the left hub comprising a braking device for braking the rotation of the left hub in the counterclockwise direction, said braking device having a left cap and being actuatable by a clockwise movement of the left hand-rim with respect to the left side shaft, said left cap having a conical surface;

a right anti-rotation element fixed to the right side shaft and having an aperture which engages the right lug of the frame, the right freewheel having an inner ring fixed with respect to the right anti-rotation element and an outer ring fixed with respect to said right cap; and a left anti-rotation element fixed to the left side shaft and having an aperture which engages the left lug of the frame, the left freewheel having an inner ring fixed with respect to the left anti-rotation element and an outer ring fixed with respect to said left cap.

8. The wheelchair of claim 7, wherein the right and left freewheels are roller freewheels.

9. The wheelchair of claim 7, further comprising a right rapid connection system for the right side shaft, formed by a right rod passing through the right side shaft and a right coaxial pin passing through the right rod, a wall of the right rod having apertures for a passage of balls radially mobile between a deployed position where they form a protuberance in relation to an outer surface of the right rod, thus increasing a cross-section of said right rod, and one centripetal position where they are flush, the balls cooperating with the right coaxial pin in such way that the balls are pushed to the deployed position when the right coaxial pin engages the right rod; and a left rapid connection system for the left side shaft, formed by a left rod passing through the left side shaft and a left coaxial pin passing through the left rod, a wall of the left rod having apertures for a passage of balls radially mobile between a deployed position where they form a protuberance in relation to an outer surface of the left rod, thus increasing a cross-section of said left rod, and one centripetal position where they are flush, the balls cooperating with the left coaxial pin in such way that the balls are pushed to the deployed position when the left coaxial pin engages the left rod.

10. The wheelchair of claim 7, wherein the right hub of the right wheel is arranged between the right hand-rim and said right anti-rotation element, and wherein the left hub of the left wheel is arranged between the left hand-rim and said left anti-rotation element.

11. The wheelchair of claim 7, wherein the right lug is radially distant from the right side shaft.

* * * * *